US005865373A

United States Patent [19]

Buckley et al.

[11] Patent Number: 5,865,373

[45] Date of Patent: Feb. 2, 1999

[54] FUEL PUMP/INJECTOR

[75] Inventors: Paul Buckley, Rainham; Michael Peter Cooke, Gillingham, both of England

[73] Assignee: Lucas Industries, Solihull, England

[21] Appl. No.: 780,928

[22] Filed: Jan. 9, 1997

[30] Foreign Application Priority Data

Jan. 13, 1996 [GB] United Kingdom ..... 9600771

[51] Int. Cl.[6] ..... F02M 51/00

[52] U.S. Cl. ..... 239/90; 239/88; 239/533.8

[58] Field of Search ..... 239/88–92, 93, 239/96, 124, 533.8

[56] References Cited

U.S. PATENT DOCUMENTS

| | | | |
|---|---|---|---|
| 3,075,707 | 1/1963 | Rademaker . | |
| 3,115,304 | 12/1963 | Humphries | 239/533.8 X |
| 3,747,857 | 7/1973 | Fenne | 239/533.8 X |
| 4,392,612 | 7/1983 | Deckard et al. | 239/88 |
| 4,402,456 | 9/1983 | Schneider . | |
| 4,503,825 | 3/1985 | Schneider | 239/95 X |
| 4,979,676 | 12/1990 | Hehn | 239/533.8 X |
| 5,082,180 | 1/1992 | Kubo et al. | 239/90 X |
| 5,423,484 | 6/1995 | Zuo | 239/90 |
| 5,429,309 | 7/1995 | Stockner | 239/533.8 |
| 5,443,209 | 8/1995 | VanAllsburg | 239/90 |
| 5,452,858 | 9/1995 | Tsuzuki et al. | 239/533.8 |
| 5,524,826 | 6/1996 | Mueller et al. | 239/88 |
| 5,533,672 | 7/1996 | Peters | 239/88 |

FOREIGN PATENT DOCUMENTS 2 227 056 7/1990 United Kingdom .

*Primary Examiner*—Andres Kashnikow
*Assistant Examiner*—Steven J. Ganey
*Attorney, Agent, or Firm*—Ryndak & Lyerla

[57] ABSTRACT

A pump/injector arrangement comprises a pump including a pump chamber arranged to communicate through a fuel line with an injector. A valve is provided within the injector to control whether or not fuel is able to flow from the fuel line to a control chamber. The control chamber communicates with a low pressure reservoir through a restricted passage. A by-pass is provided to permit fuel to flow from the reservoir by-passing the restricted passage.

8 Claims, 3 Drawing Sheets

FUEL PUMP/INJECTOR

This invention relates to a pump/injector for supplying fuel to an internal combustion engine and of the kind comprising a cam actuated pumping plunger slidable within a bore formed in a housing, an outer from the bore, said outlet being connected to the inlet of a fuel injection nozzle which is mounted on the housing, the fuel injection nozzle including a fuel pressure actuated resiliently biased valve member for controlling fuel flow from the nozzle inlet to an outlet orifice and valve means operable to spill fuel displaced by the plunger during its inward movement in the bore to control the timing and the quantity of fuel supplied to the nozzle inlet.

The object of the invention is to provide a pump/injector of the kind specified in a simple and convenient form.

According to the present invention there is provided a fuel pump/injector arrangement comprising a fuel pump including a pump chamber, a fuel line communicating with the pump chamber, and an injector which includes a fuel pressure actuated valve needle biased into engagement with a seating to control fuel flow between the fuel line and an outlet orifice, the valve needle having a surface associated therewith located within a control chamber, a valve located within the injector and operable to permit fuel flow between the fuel line and the control chamber, a restricted flow path whereby fuel is able to flow from the control chamber to a supply chamber at a restricted rate, and a by-pass valve operable to permit fuel to flow from the supply chamber to the valve by-passing the restricted flow path.

The valve may take the form of a valve member moveable into engagement with a seating under the action of pressurized fuel applied thereto, or alternatively may comprise a valve member coupled to the armature of an electromagnetic actuator.

The invention will further be described, by way of example, with reference to the accompanying drawings, in which.

Figure 1:
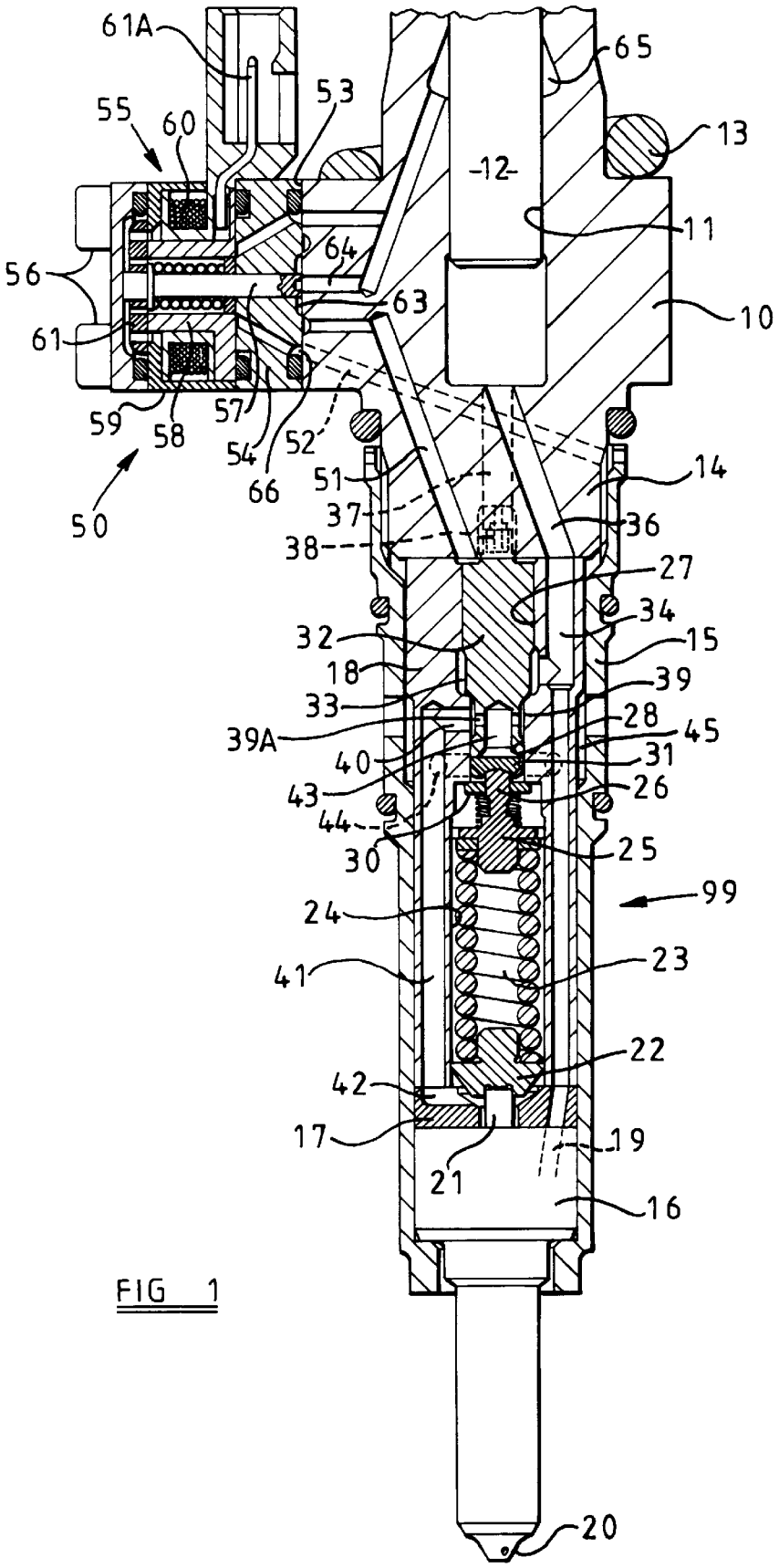
FIG. 1 is a sectional view of a pump/injector in accordance with a first embodiment.

Referring to FIG. 1 of the drawings the pump/injector comprises a housing 10 in which is formed a bore 11 and slidable in the bore is a pumping plunger 12 which extends from the outer end of the bore. The plunger is adapted to be moved inwardly towards the inner end of the bore by an engine driven cam (not shown) and outwardly by the action of a return spring part of which is seen at 13.

The housing defines a peripherally screw threaded cylindrical spigor 14 which in the example, is co-axial with the bore and to which an injector 99 is secured. The injector 99 comprises a cap nut 15 which is engaged with the threaded spigot 14, and which at its end remote from the spigot has an inwardly directed flange which engages a step defined on a fuel injection nozzle body 16. Located adjacent the nozzle body is a distance piece 17 and positioned between the distance piece and the spigot 14 is a cylindrical valve housing 18. When the cap nut is tightened the nozzle body 16, the distance piece 17 and the valve housing 18 are held in assembled relationship on the spigot and fuel tight seals are established between the adjacent faces of these components.

The nozzle body 16 is of standard construction and incorporates a seated fuel pressure actuated valve needle which is lifted from its seat to allow fuel flow from a nozzle inlet 19 through an outlet orifice 20, by the pressure of fuel supplied to the inlet 19. The valve needle of the nozzle is provided with an extension 21 which projects through an opening in the distance piece and carries a spring abutment 22 which is engaged by one end of a return spring 23.

The return spring 23 and the spring abutment 22 are housed within a cylindrical spring chamber 24 formed in the valve housing 18 and the other end of the return spring engages by way of a shim, a further spring abutment 25 which is slidable within the spring chamber. The spring abutments 22 and 25 each define a clearance with the wall of the spring chamber. The spring abutment 25 is provided with a peg 26 which extends into the narrower portion 28 of a valve guide bore which has a wider portion 27. The peg 26 carries a valve plate 30 which is lightly spring loaded into engagement with the end wall of the spring chamber. Valve plate 30 and the end wall of spring chamber 24 together constitute the bypass valve of the first embodiment of the invention. The peg has a rounded end and is engaged within a complementary recess in a pressure pad 31 which is slidable in the narrower portion 28 of the valve guide bore. The pad 31 is urged into engagement by the spring 23, with the narrower end of a stepped valve member 32 which is slidable in the wider and narrower portions of the valve guide bore.

At the junction of the narrower and wider portions 28, 27 of the valve guide bore there is formed an annular seating which can cooperate with a complementary seating surface defined on the valve member 32 as will be explained. At its end adjacent the narrower portion 28 of the valve guide bore, the wider portion 27 is enlarged to define an annular gallery 33 and this is in constant communication with a passage 34 which is formed in the valve housing 18 and which at one end by way of a passage in the distance piece 17, communicates with the nozzle inlet 19 and at its other end communicated with the inner end of the plunger bore 11 by way of a passage 36 in the housing 14. The inner end of the plunger bore also communicates with the wider end 27 of the valve guide bore by way of a central passage 37 in the housing 10, this passage incorporating a restrictor 38.

The narrower end of the valve member 32 is provided with a circumferential groove 39. This is located adjacent the seating surface and it is in constant communication with a port 40 which communicates by way of a passage 41 and a shaped recess 42 in the distance piece 17, with the end of the spring chamber 24 adjacent the spring abutment 22. The groove 39 also communicates by way of restricted passages 39A with a chamber 43 defined in the narrower end of the valve member 32. The pressure pad 31 also acts as a closure for the open end of the chamber 43 and can be lifted against the action of the spring 23, to allow fuel to flow out of the chamber. Moreover, formed in the wall of the valve housing 18 is at least a pair of supply ports 44 which open into the narrower portion 28 of the valve guide bore and at their outer ends open into a fuel supply chamber 45 defined between the skirt of the cap nut and the valve housing, this chamber in use communicated with a source of fuel by way of openings in the skirt.

An electromagnetically operable valve 50 is mounted on the housing 10 and this controls communication between passages 51 and 52 formed in the housing 10. Both passages open onto a valve support face 53 defined by the housing, the passage 51 at its other end opening into the end of the wider portion 27 of the valve guide bore and the passage 52 at its other end opening to the exterior of the housing 10. The control valve 50, which is an electromagnetic controller, included a valve housing 54 and an actuator 55 mounted on the face of the valve housing remote from the support face 53. Bolts 56 are provided to maintain the two parts of the valve 50 in assembled relationship and in facial engagement with the housing 10. The valve housing 54 defines a central drilling in which is located an axially movable valve member 57 which extends into the actuator 55 the later includes an annular outwardly flanged inner core member 58 and an outer core member 59 having an inwardly directed flange. Within the core members there is located a winding 60 connected to supply terminals 61A and the end of the inner core member together with the adjacent surface of the inwardly directed flange of the outer core member 59 define pole faces which when the winding is supplied with electric current, assume opposite magnetic polarity. The valve member 57 carries a plate like armature 61 and a return spring is located about the extending portion of the valve member 57 which urges the armature away from the pole faces.

The valve housing 54 in its surface presented to the valve support face 53 is provided with a recess 63 which is in constant communication with the passage 51 by way of an edge filter, and opening into the recess 63 at a central position is a port 64 which when the winding is supplied with electric current, is closed by the valve member 57. The port 64 communicates with a leakage groove 65 which is formed in the wall of the bore 11 and also with an annular recess 66 which is located outwardly of the recess 63. The recess 66 communicates with the passage 52 and also by way of passages formed in the valve housing 54, with the interior of the actuator 55.

The operation of the pump injector will now be described, it being assumed that the pumping plunger 17 is being moved inwardly by the action of the engine driven can and that the winding 60 is supplied with electric current so that the port 64 is closed. In this situation, the fuel pressure acting on the wider end of the valve member 32 will be the same as the fuel pressure existing in the bore 11 and the passage 34. The valve member 32 has an intermediate portion lying within the chamber 33 which is slightly smaller than the diameter of the wider portion of the valve member 32 and hence a force will be generated which acts to move the valve member 32 away from the seating. However, the force generated by the fuel pressure acting on the wider end of the valve member 32 will be substantially higher and therefore the valve member 32 will be moved into engagement with the seating against the action of the spring 23. When the fuel pressure supplied to the fuel inlet 19 of the fuel injection nozzle rises to a sufficiently high valve, the valve needle of the nozzle will be lifted from its seating against the action of the spring 23 and fuel will flow through the orifice 20 to the associated engine. The fuel supply will continue so long as electric current is supplied to the winding 60. When the winding 60 is de-energised the valve member 57 moves under the action of its return spring, to place the port 64 in communication with the recess 63 and fuel can now flow from the recess into the port 64 and from the port into the recess 66 and by way of the passage 52 to the exterior of the housing. The practical effect is that the pressure acting upon the wider end of the valve member 32 is reduced due to the effect of the restrictor 38, so that the force acting on the valve member 32 due to fuel pressure within the chamber 33 and the spring force, is sufficient to move the valve member 32 axially away from the seating. Such movement permits fuel to flow past the seating into the groove 39 and from this groove into the chamber 43 through the restricted passages 39A. From this chamber the fuel can flow past the pressurizing valve defined by the pad 31 and the spring 23 into the ports 44 and into the supply chamber 45. The pressure therefore of fuel within the passage 34 falls to allow the valve needle in the fuel injection nozzle to close. The closing movement of the nozzle is effected by the spring 23 but it is also assisted by the fuel pressure which is transmitted by way of the port 40 and the passage 41 to the spring chamber 24. This pressure acts upon the valve needle of the fuel injection nozzle. Moreover, the flow through the ports 44 is restricted due to the restricted passage 39A and the pressurising valve. The pressurising valve ensure that there is adequate pressure available at low speeds to operate the valve member 32. The flow of fuel through the ports 44 will continue so long as the plunger is moved inwardly and so long as the winding 60 remains de-energised. If during inward movement of the plunger 12 the winding 60 is re-energised, the valve member 57 moves to obturate the port 64 and this allows the pressure acting on the wider end of the valve member 32 to increase so that the spillage of fuel is prevented and fuel supply to the associated engine is restored. It is thus possible to control the timing of fuel delivery to the associated engine and also the quantity of fuel delivered to the engine by controlling the flow of current in the winding 60. It is also possible to provide for pilot injection where a small quantity of fuel is first delivered to the engine to allow the combustion process to start followed by the main quantity of fuel.

When the plunger 12 is moved outwardly by its spring, the fuel pressure in the inner end of the bore 11 is depressed so whether or not the winding 60 is supplied with current, the valve member 32 will be lifted from its seating. Moreover, the pressure of fuel supplied through the ports 44 will be sufficient to lift the valve plate 30 away from the end wall of the spring chamber to permit fuel flow into the spring chamber and then by way of the passage 41 and the ports 40, into the gallery 33 and from the gallery into the bore 11. In the event that the valve member 32 sticks for some reason then if it sticks in the closed position the bore 11 will not fill with fuel and if it sticks in the open position all the fuel delivered from the bore will be spilled.

Figure 2:
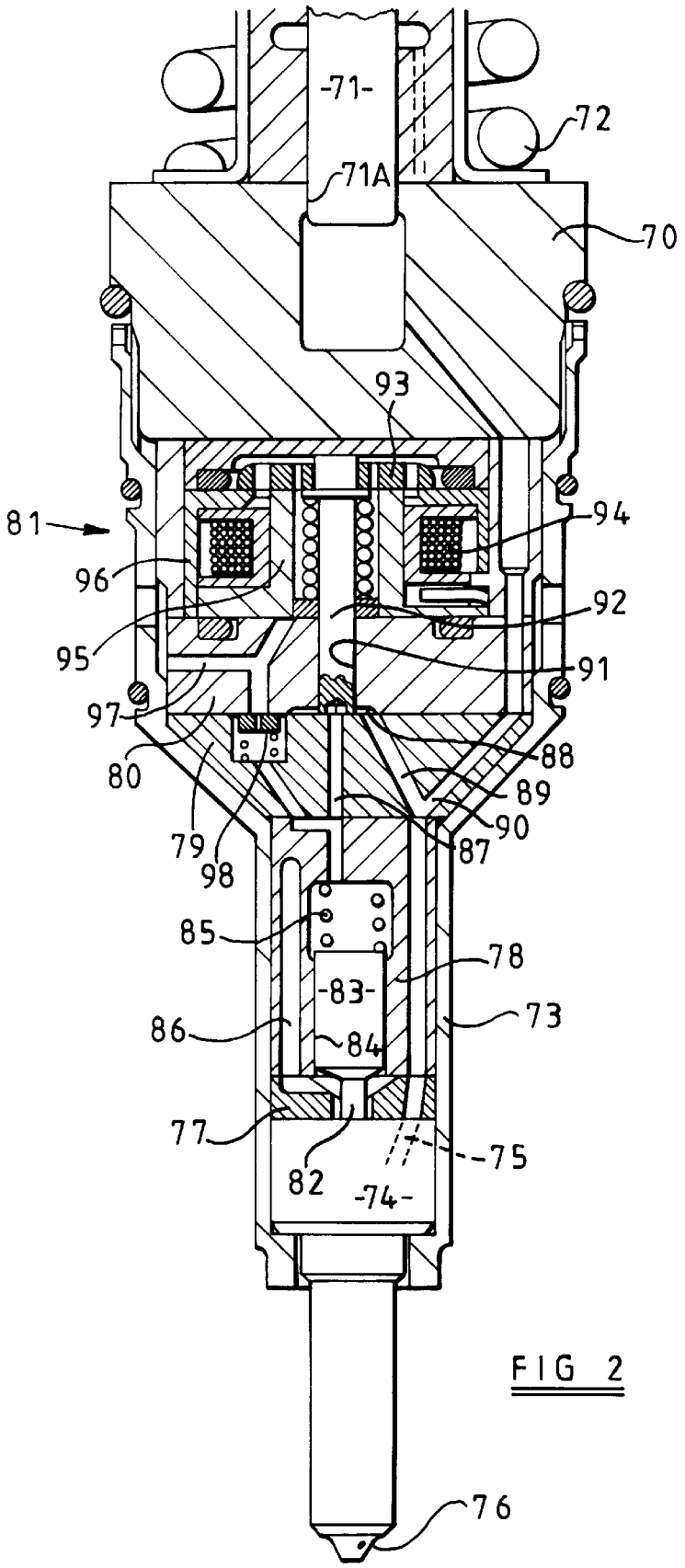
FIG. 2 is a view similar to FIG. 1 of a second embodiment.

Referring to FIG. 2 of the drawings the pump injector shown includes a housing 70 in which is defined a plunger bore 71A. Slidable in the bore is a pumping plunger 71 which is movable inwardly by an engine driven cam and outwardly by the action of a plunger return spring 72. Secured to the housing by means of a screw threaded cap nut 73 is a fuel injection nozzle body 74 in which is located a fuel pressure actuated valve needle which controls fuel flow from a nozzle inlet 75 to an outlet orifice 76. The nozzle body is engaged by a distance piece 77 and the distance piece by a piston housing 78 which in turn is engaged by a truncated conical spacer member 79.

The spaced member 79 is engaged by a control valve body 80 and interposed between the body 80 and the housing 70 is an electromagnetic actuator 81, which is an electromagnetic controller. The various components are held in assembled relationship by the cap nut and the clamping force which is generated upon tightening of the cap nut, urges the cooperating surfaces of the components into fuel tight sealing engagement.

The valve needle of the nozzle has an extension 82 which projects through an opening in the distance piece 77 and is engaged by a piston 83 slidable within a bore 84 formed in the piston housing 78. A light spring 85 is interposed between the piston and the end wall of the bore to provide a biasing force which maintains the engagement of the piston and the extension of the valve needle. A space is defined around the extension of the valve needle and this space communicates with a drain by way of a passage 86 formed in the piston housing, this passage communicating with the exterior of the pump injector by way of further passages not shown.

The portion of the bore 84 which contains the spring 85 communicates with a passage 87 formed in the spacer member 79. These constitute the control chamber of the FIG. 2 embodiment of the invention. The passage opens into a recess 88 formed in the face of the control valve body presented to the spacer member and the recess is in permanent communication with one end of a passage 89. The other end of the passage 89 communicates with a multi-part passage 90 and at one end this passage connects with the nozzle fuel inlet 75 and at its other end with the inner end of the bore 71A.

The control valve body 80 is formed with a central drilling 91 which opens into the recess and slidable in the drilling is a valve member 92 on which is mounted an armature 93 which forms part of the actuator 81. The valve member 92 and armature 93 are biased in the direction away from the valve body 80 by means of a coiled spring which is interposed between a flange on the armature and the valve body. The armature 93 and valve member 92 are movable against the action of the spring by supplying electric current to an annular winding 94 which surrounds an inner annular core member 95 having an outwardly directed flange at one end. An outer annular core member 96 surrounds the winding and has an inwardly directed flange which together with the end of the inner core member, forms a pair of pole faces which assume opposite magnetic polarity when the winding is supplied with electric current. When the winding is supplied with current the valve member 92 and armature 93 move against the action of the spring and the end of the valve member 92 within the recess moves to obturate the passage 87.

The portion of the bore 84 which contains the spring 85 also communicates with a fuel supply passage 97, this passage incorporates a non-return valve 98 which can open in the direction to allow fuel flow towards the bore 84 and which incorporates a restrictor in its valve member.

In operation, and assuming that the plunger 71 is being moved inwardly by the engine driven cam and that the winding 94 is de-energised. In this situation fuel displaced by the inward movement of the plunger will flow by way of the passage 90, the passage 89 and the passage 87, into the end of the bore 84 which contains the spring. Fuel flows from this portion of the bore by way of the restrictor which defines a restricted flow path, and a fuel pressure exists within the bore, this pressure acting on the piston 83 to urge the valve needle of the fuel injection nozzle into engagement with its seating. The area of the end of the piston 83 is substantially higher than the surfaces of the valve needle of the fuel injection nozzle which are exposed to the same pressure. The valve needle of the fuel injection nozzle will therefore be maintained in engagement with its seating. If now the winding is supplied with electric current the valve member 92 moves to close the passage 87. This has the effect of preventing spillage of the fuel displaced from the plunger bore 71A and it also allows the fuel pressure in the end of the bore 84 to fall to that of the drain. As a result the force generated by the fuel pressure acting on the piston 83 is reduced and the fuel pressure acting on the surfaces of the valve needle of the fuel injection nozzle increases so that the valve needle moves away from the seating and flow of fuel takes place through the orifice 76. This flow of fuel continues for so long as the pumping plunger is being moved inwardly and the winding is energised. If the winding is de-energised the valve member 92 opens the passage 87 so that fuel at high pressure flows into the bore 84 thereby increasing the fuel pressure acting upon the piston 83 and decreasing the pressure of the fuel which is supplied to the nozzle inlet 75. The overall effect is to cause movement of the valve needle of the fuel injection nozzle to the closed position thereby terminating delivery of fuel to the associated engine. If now the winding is re-energised the valve needle member of the fuel injection nozzle is moved to the open position so that the supply of fuel to the engine is restored. When the plunger 71 moves outwardly under the action of its spring 72, fuel under pressure from the source flows by way of the aforesaid non-return valve into the portion of the bore 84 which contains the spring and providing the passage 87 is uncovered by the valve member 92 flows by way of this passage and the passages 89 and 90 to the bore 71 so that the latter is completely filled with fuel prior to the next inward movement of the pumping plunger.

Figure 3:
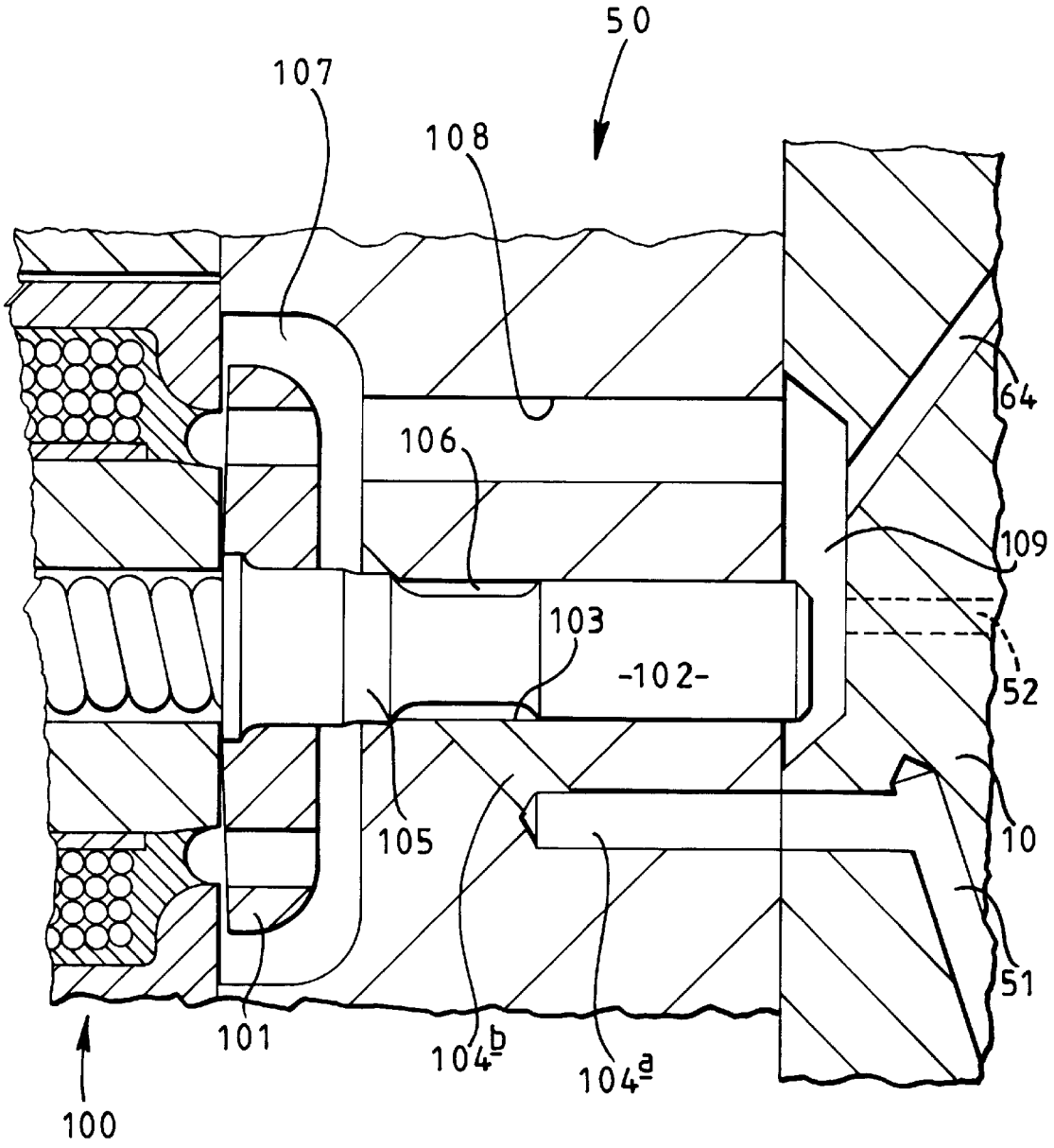
FIG. 3 is a sectional view of part of a modification to the FIG. 1 embodiment.

FIG. 3 illustrates a modification to the embodiment of FIG. 1. The modification relates to the nature of the electromagnetically actuated control valve 50. In the modification of FIG. 3, the valve 50 comprises an electromagnetic actuator 100 including an armature 101 coupled to a cylindrical valve member 102. The valve member 102 is slidable within a bore 103 which communicates through passages 104*a*, 104*b* with the passage 51 provided in the housing 10 shown in FIG. 1.

The valve member 102 includes a region 105 of enlarged diameter which is engageable with a seating defined around an end of the bore 103. The part of the valve member 102 adjacent the point at which the passage 104*b* breaks into the bore 103 is of reduced diameter, defining with the bore an annular chamber 106 located upstream of the seating.

Downstream of the seating, the bore 103 opens into a chamber 107 within which the armature 101 is located. The chamber 107 communicates through a drilling 108 with a recess 109 provided in the housing 10. The recess 109 communicates with passages 52, 64 similar to those of the FIG. 1 embodiment which communicate with the exterior of the housing 10 and a leakage groove respectively. The end of the valve member 102 remote from the armature 101 also extends into the recess 109.

In use, in the position shown, the actuator is not energized, the valve member 102 being spring biased into engagement with its seating. While the plunger is moving inwards, in this position of the control valve the fuel pressure applied to the annular chamber 106 is high. The parts of the valve member 102 exposed to high pressure fuel are of substantially equal area, thus the valve member 102 is substantially pressure balanced.

Energisation of the actuator 100 lifts the valve member 102 from its seating thus high pressure fuel can escape from the passage 51 through the drilling 108 and passage 52 to the exterior of the housing 10. Once the valve member 102 is lifted from its seating, a greater area of the valve member is exposed to high pressure fuel, and the force applied to the valve member 102 by the application of high pressure fuel thereto assists the actuator in moving the valve member 102.

De-energizing the actuator results in the valve member returning to the position shown as a result of the spring biasing of the valve member.

Although the modification illustrated in FIG. 3 is described as a modification to the FIG. 1 embodiment, substantially the same modification could be made to the FIG. 2 embodiment.

We claim:

1. A fuel pump/injector arrangement comprising a fuel pump including a pump chamber, a fuel line communicating with the pump chamber, and an injector which includes a fuel pressure actuated valve needle arranged to control fuel flow between the fuel line and an outlet orifice, the valve needle having a surface associated therewith located within a control chamber, a valve located within the injector and operable under the influence of an electromagnetic controller to permit fuel flow from the fuel line and the control chamber to terminate injection of fuel, a restricted flow path whereby fuel is able to flow from the control chamber to a supply chamber at a restricted rate, and a by-pass valve operable to permit fuel to flow from the supply chamber to the valve by-passing the restricted flow path.

2. An arrangement as claimed in claim 1, wherein the valve comprises a valve member biased by a spring away from a seating, the valve member including a surface to which fuel from the pump chamber is applied to apply a force to the valve member against the action of the spring.

3. An arrangement as claimed in claim 2, wherein a restrictor is provided between the pump chamber and the said surface of the valve member.

4. An arrangement as claimed in claim 3, wherein the fuel pressure applied to the said surface of the valve member is controlled by an electromagnetically actuable control valve.

5. An arrangement as claimed in claim 1, wherein the valve comprises a valve member coupled to an armature of an electromagnetic actuator of the electromagnetic controller and engageable with a seating to control communication between the fuel line and control chamber.

6. An arrangement as claimed in claim 1, further comprising a pressurising valve arranged to prevent the flow of fuel to the supply chamber when the fuel pressure in the supply line falls below a predetermined level.

7. An arrangement as claimed in claim 1, wherein the by-pass valve comprises a non-return valve resiliently biased to a closed position.

8. A fuel pump/injector arrangement comprising a fuel pump including a pump chamber, a fuel line communicating with the pump chamber, and an injector which includes a fuel pressure actuated valve needle arranged to control fuel flow between the fuel line and an outlet orifice, the valve needle having a surface associated therewith located within a control chamber, a valve located within the injector and operable by an electromagnetic controller to permit fuel flow from the fuel line to the control chamber to terminate injection of the fuel, a restricted flow path whereby fuel is able to flow from the control chamber to a supply chamber at a restricted rate, and a by-pass valve operable to permit fuel flow from the supply chamber to the valve by-passing the restricted flow path, wherein the by-pass valve comprises a non-return valve resiliently biased to a closed position, said by-pass valve having an opening of restricted diameter which defines the restricted flow path to permit the flow of fuel at said restricted rate to the supply chamber.

* * * * *